US007300130B2

(12) United States Patent
Bellinger et al.

(10) Patent No.: US 7,300,130 B2
(45) Date of Patent: Nov. 27, 2007

(54) PRINT CARTRIDGE TEMPERATURE CONTROL

(75) Inventors: Teresa Bellinger, Vancouver, WA (US); Erick Kinas, Camas, WA (US); Jeffrey Gent, Eugene, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/237,307

(22) Filed: Sep. 27, 2005

(65) Prior Publication Data

US 2006/0023016 A1 Feb. 2, 2006

(51) Int. Cl.
*B41J 29/38* (2006.01)

(52) U.S. Cl. ..... 347/17

(58) Field of Classification Search ..... 347/17, 347/84–87

See application file for complete search history.

(56) References Cited

U.S. PATENT DOCUMENTS

| | | | | |
|---|---|---|---|---|
| 4,190,846 | A | 2/1980 | Yamamoto | |
| 4,320,407 | A | 3/1982 | Goldis | |
| 4,346,388 | A | 8/1982 | Wiley | |
| 4,658,268 | A | 4/1987 | Needham | |
| 4,897,762 | A | 1/1990 | Daikoku | |
| 4,929,963 | A | 5/1990 | Balazar | |
| 4,968,998 | A | 11/1990 | Allen | |
| 5,017,941 | A | 5/1991 | Drake | |
| 5,040,002 | A | 8/1991 | Pollacek | |
| 5,220,345 | A * | 6/1993 | Hirosawa | 347/17 |
| 5,455,606 | A | 10/1995 | Keeling et al. | |
| 5,505,339 | A | 4/1996 | Cowger | |
| 5,818,485 | A | 10/1998 | Rezenka | |
| 5,886,718 | A | 3/1999 | Johnson et al. | |
| 5,923,353 | A | 7/1999 | Boyd | |
| 5,936,650 | A | 8/1999 | Ouchida | |
| 5,980,028 | A | 11/1999 | Seccombe | |
| 5,988,802 | A | 11/1999 | Pawlowski et al. | |
| 6,024,441 | A | 2/2000 | Nishimoto | |
| 6,050,680 | A | 4/2000 | Moriyama | |
| 6,116,727 | A | 9/2000 | Hagiwara | |
| 6,168,268 | B1 | 1/2001 | Sugiyama | |
| 6,213,598 | B1 | 4/2001 | Hou | |
| 6,290,323 | B1 | 9/2001 | Sharma | |
| 6,312,113 | B1 | 11/2001 | Murad | |
| 6,371,607 | B2 | 4/2002 | Wouters | |
| 6,390,585 | B1 | 5/2002 | Schiaffino | |
| 6,428,156 | B1 | 8/2002 | Waller | |
| 6,431,694 | B1 | 8/2002 | Ross | |
| 6,478,415 | B2 | 11/2002 | Barinaga | |
| 6,712,461 | B2 | 3/2004 | Haan | |

OTHER PUBLICATIONS

Kent, U.S. Appl. No. 10/285,251, Recirculating Inkjet Printing System, Oct. 31, 2002, Assignee: Hewlett-Packard Company.

* cited by examiner

*Primary Examiner*—An H. Do

(57) ABSTRACT

A print cartridge temperature control apparatus and method are disclosed. In one embodiment, ink passes from a first chamber, across a printhead, and to a second chamber to control the temperature of the printhead.

4 Claims, 5 Drawing Sheets

PRINT CARTRIDGE TEMPERATURE CONTROL

CROSS-REFERENCE TO RELATED APPLICATION

This application claims priority of U.S. patent application Ser. No. 10/618,466, now U.S. Pat. No. 6,984,029, filed Jul. 11, 2003, the disclosure of which is hereby incorporated by reference.

BACKGROUND

Inkjet printing is a technology that uses drops of ink to form an image on a print medium, such as paper. According to some implementations, drops of ink are fired through nozzles formed in a printhead.

In many inkjet applications, such as thermal inkjet applications the temperatures within the print cartridge vary during operation. For example, at printer startup, the printhead temperature is typically below a normal operating temperature. The printhead temperature then tends to increase as the associated printer warms up and printing occurs.

As the temperature of a printhead varies, the drop volume (i.e., the amount of ink ejected from a printhead nozzle) also tends to vary. For example, as the temperature of a printhead increases, the drop volume of the ink ejected from the printhead tends to increase. Likewise, as the temperature of the printhead decreases, the drop volume of the ink ejected from the printhead also tends to decrease.

This temperature-dependent variation in drop volume may adversely affect the quality of a printed image. For example, drop volumes that are too small may result in streaking. Conversely, drop volumes that are too large may increase drop drying times, paper cockle, or both. Variation in drop sizes across a print or from print to print may also cause undesirable hue shifts, in some applications. For these and other reasons, there is a need for the present print cartridge temperature control.

BRIEF DESCRIPTION OF THE DRAWINGS

In the drawings, like numbers are used to refer to like parts throughout.

DETAILED DESCRIPTION

Figure 1:
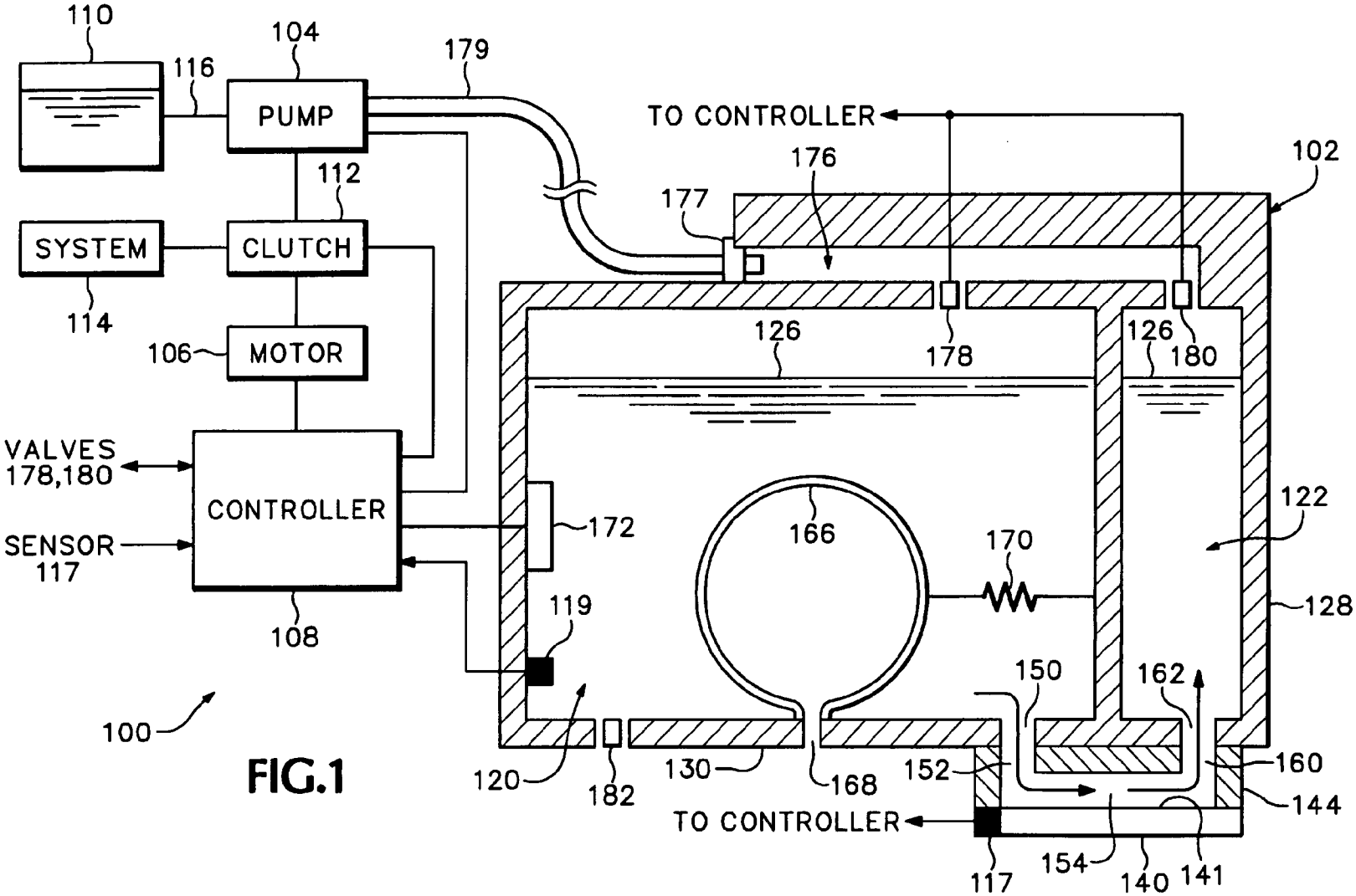
FIG. 1 is schematic diagram of a print cartridge and associated components in accordance with an example embodiment.

FIG. 1 illustrates a system 100 having a print cartridge 102, a pump 104, a motor 106, a controller 108, and an external ink supply 110. The print cartridge 102 may also be referred to as a "pen". In general, the motor 106 drives the pump 104 to pump fluid into and out of the print cartridge 102 based on signals received from the controller 108. The pump 104 pulls, or draws, fluid from, and pushes fluid into, the external ink supply 110 via a conduit 116, which may comprise a tube. The pump 104 may comprise a bi-directional peristaltic pump or other suitable pumping mechanism. The fluid typically includes ink, air, foam, or a combination of these.

An optional clutch 112 is operative to permit the motor 106 to selectively drive the pump 104 or system 114 based on control signals received from the controller 108. In one embodiment, the system 114 comprises a mechanism for advancing, or otherwise handling, print media, such as paper, through a printer (see, FIG. 5). Pursuant to this embodiment, the motor 106 drives the system 114 during printing. By operation of the clutch 112, the motor 106 may be used to drive the pump 104 when not printing. The clutch 112 switches delivery of rotational power between the pump 104 and the system 114 based on control signals received from the controller 108.

Hence, because the pump 104 and the system 114 are used at different times, a single motor 106 may be used to drive the pump 104 and the system 114, thereby eliminating the need for, and cost of, multiple motors to drive these devices. Further, in the configuration shown in FIG. 1, a power supply (not shown) does not need to drive separate motors for the system 114 and the pump 104 at the same time, thereby reducing the load on such a power supply. Hence, a lower capacity power supply may be employed to selectively drive the pump 104 and the system 114 than would be required to drive both the pump 104 and the system 114 simultaneously.

The print cartridge 102 shown in FIG. 1 includes a chamber 120 and a snorkel 122 separated by an inner wall 124. In the illustrated embodiment, the snorkel comprises a chamber within the print cartridge 102 and has a volume significantly less than that of the chamber 120. Pursuant to one embodiment, the volume of the snorkel 122 is about ⅓ to 1/10 of the volume of the chamber 120, although other suitable ratios may alternatively be employed. The chamber 120 and the snorkel 122 are further defined by external side walls 128 and floor 130. As shown, the chamber 120 and the snorkel 122 each have a quantity of ink 126 disposed therein. An air gap above the ink 126 in the chamber 120 is typical, even for a "full" chamber.

A printhead 140 is mounted on base 144. In other embodiments an intermediate member may be disposed between the printhead 140 and the base 144. In FIG. 1, the base 144 is illustrated as being attached to the floor 130 of the print cartridge 102. Alternatively, the base 144 may be formed integrally with the floor 130. An aperture 150 is formed in the floor 130 of the print cartridge 102 such that the aperture 150 is in fluid communication with the chamber 120. A filter (not shown) may optionally be disposed between the chamber 120 and the aperture 150. A corresponding aperture 152 is formed in the base 144 and is in fluid communication with the aperture 150. An aperture 162 is formed in the floor 130 and in fluid communication with the snorkel 122. A channel 154 is formed between aperture 150 and aperture 162. The channel 154 has an inlet at aperture 152 and an outlet at aperture 160. The channel 154 is defined by a bottom surface of the base 144 and a top surface 141 of the printhead 140.

In one embodiment, the base 144 may be configured as a manifold to permit ink from the chamber 120, as well as from other sources (not shown), to be delivered to the printhead 140. These other sources may include, for example, one or more chambers other than the chamber 126. Likewise, when configured as a manifold, the base 144 permits ink at the printhead 140 to pass from the printhead 140 through the base 144 to the snorkel 122 as well as to other destinations. These other destinations may include, for example, one or more snorkels other than the snorkel 122.

Accordingly, and as described in more detail below, under certain conditions, ink 126 disposed in the chamber 120 may pass through the apertures 150, 152 and through the channel 154. The ink then passes through apertures 160, 162 into the snorkel 122.

An accumulator bag 166 is disposed within the chamber 120. The accumulator bag 166 has an internal volume that is in fluid communication with ambient pressure via a hole 168. In FIG. 1, the hole 168 is shown as being formed in the floor 130, but the hole 168 may alternatively be formed through a sidewall 128 or other suitable structure.

A bias member 170, such as a spring, is coupled to the accumulator bag 166 to compress the accumulator bag 166 as ink is delivered to, and fills, the chamber 120. The bias member 170 may also be secured to a surface of the internal wall 124 as shown in FIG. 1 or to another suitable surface within the chamber 120.

A heating element 172 is shown in FIG. 1 as disposed within the chamber 120. The heating element 172 is controlled by the controller 108 to selectively heat the ink 126 disposed within the chamber 120. In some circumstances, it may be desirable to heat the ink 126 in the chamber 120 to a desired temperature or for a predetermined amount of time. For example, it may be desirable to heat the ink 126 at printer startup or when the temperature at the printhead 140 is below a predetermined temperature. Accordingly, under certain circumstances, the controller 108 activates the heating element 172. The controller 108 is also operable to deactivate, or turn off, the heating element 172 when certain conditions are satisfied. For example, the controller 108 may deactivate the heating element 172 when the temperature of the printhead is above a certain temperature or after the heating element has been active for a predetermined amount of time. The heating element 172 may comprise an electrical resistive heating element or other suitable heating element.

The print cartridge 102 has a port 176. As described in more detail below, the port 176 may be used as an inlet and as an outlet. A conduit 179 connects the port 176 with the pump 104 to permit the pump 104 to push and pull fluid into and out of the print cartridge 102. The conduit 179 may comprise a section of rubber tubing or other suitable material. As shown in FIG. 1, an optional barb 177 may be formed at an end of the conduit 179 to facilitate a tight, secure coupling between the conduit 179 and the port 176.

A chamber valve 178 is disposed between the chamber 120 and the port 176 to control passage of fluids, such as ink and air, between the chamber 120 and the port 176. The chamber valve 178 is operable between open and closed positions. In the open position, the chamber valve 178 permits passage of fluids between the port 176 and the chamber 120. In the closed position, the chamber valve 178 prevents passage of fluids between the port 176 and the chamber 120. As shown, the position of the chamber valve 178 is controlled by the controller 108.

A snorkel valve 180 is disposed between the snorkel 122 and the port 176 to control passage of fluids, such as ink and air, between the snorkel 122 and the port 176. The snorkel valve 180 is operable between open and closed positions. In the open position, the snorkel valve 180 permits passage of fluids between the port 176 and the snorkel 122. In the closed position, the snorkel valve 180 prevents passage of fluids between the port 176 and the snorkel 122. As shown, the position of the snorkel valve 180 is controlled by the controller 108.

A variety of different valve mechanisms may be employed as the valves 178, 180. The valves 178, 180 may include any of numerous suitable mechanical devices by which the flow of fluid may be started, stopped, or regulated by a movable part that opens, shuts, or partially obstructs one or more ports or passageways.

A bubbler 182 is formed in the floor 130 of the print cartridge 102 for controlling the pressure inside the chamber 120. The bubbler 182 may also be referred to as a "bubble generator." The bubbler 182 may be configured to permit passage of ambient air outside the print cartridge 102 into the chamber 120 when the ambient pressure exceeds the pressure within the chamber 120 by more than a predetermined amount. Hence, when the pressure within the chamber 120 is less than ambient pressure by more than a predetermined amount, the bubbler 182 permits air to pass through the bubbler into the chamber 120. Although the bubbler 182 is shown as being formed in the floor 182, the bubbler 182 may alternatively be formed in a sidewall 128 or other suitable location.

In one embodiment, the bubbler 182 may comprise a wetted hole that admits air into the chamber 120 when the pressure in the chamber drops below a predetermined threshold relative to the ambient pressure. Pursuant to another embodiment, the bubbler 182 comprises a ball disposed within a vertically-ribbed aperture in the floor 130, the ribs permit ambient air to pass around the ball into the chamber 120.

A temperature sensor 117 is formed at or adjacent to the printhead 140. In one embodiment, the temperature sensor may comprise a resistance temperature detector that operates on the principle that the electrical resistance of a metal changes predictably and in a substantially linear and repeatable manner with changes in temperature. Other suitable temperature sensors may alternatively be employed. The controller 108 receives input from the temperature sensor 117 regarding the current temperature of the printhead 140.

Figure 2:
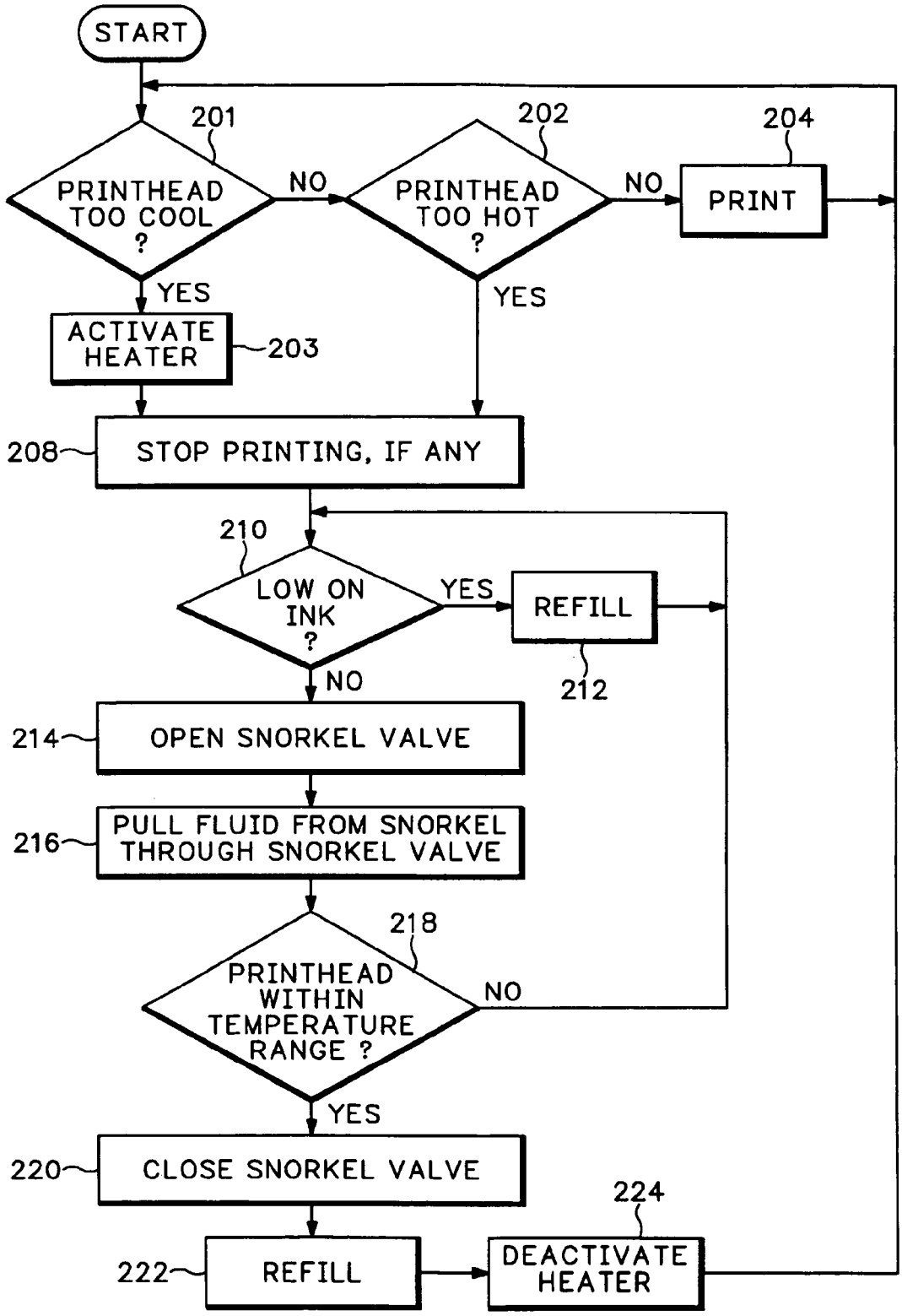
FIG. 2 is a flowchart illustrating an example method of controlling printhead temperature in accordance with an example embodiment.

FIG. 2 is a flowchart 200 illustrating an example method of controlling printhead temperature in accordance with an example embodiment. In the flowchart 200, many of the blocks are optional and are shown in an illustrative, and not restrictive, sense. Further, in some applications, the sequence of some of the blocks may vary.

At block 201, the controller 108 determines whether the printhead 140 is too cool. That is, the controller 108 receives input from the temperature sensor 117 at the printhead 140 regarding the current temperature of the printhead 140 and determines whether the current temperature of the printhead 140 is below a threshold temperature. If the controller 108 determines that the current temperature of the printhead 140 is below the threshold temperature, then execution proceeds to block 203, else execution proceeds to block 202. This threshold temperature may be different depending on the particular embodiment and application. In some embodiments, the threshold temperature is about 35-60 degrees C.

At block 203, the controller 108 activates, or turns on, the heating element 172. Once activated, or turned on, the heating element 172 heats up and transfers heat to the ink 126 disposed in the chamber 126, which, in turn, transfers heat to the printhead 140 as the heated ink is circulated across the printhead 140. Once the controller 108 has activated the heating element 172, execution proceeds to block 208.

At block 202, the controller 108 determines whether the printhead is too hot. Pursuant to one embodiment, the controller 108 receives input from the temperature sensor 117 at the printhead 140 regarding the current temperature of the printhead 140. If the controller 108 determines that the current temperature of the printhead 140 is above a predetermined temperature, the controller 108 schedules a cooling operation and execution proceeds to block 208, else execution proceeds to block 204.

At block 204, printing commences and the print cartridge 102 ejects ink from the printhead 140. After a predetermined amount of printing, such as a single print swath, execution returns to block 201.

The controller 108 may schedule the cooling operation, depending on the current temperature of the printhead 140. For example, for temperatures in a first range of temperatures, the controller 108 may schedule the cooling operation at the end of a particular print job. For temperatures in a second range of temperatures, the second range of temperatures being higher than the first range of temperatures, the controller 108 may schedule the cooling operation at the end of a printed page. Further, for temperatures in a third range of temperatures, the third range of temperatures being higher than the second range of temperatures, the controller 108 may schedule the cooling operation at the end of a current swath (i.e., pass of the print cartridge over the print media). In other embodiments, however, the controller 108 may schedule the cooling operation without regard to the amount to which the current temperature exceeds the predetermined temperature.

Once the time or circumstances of the scheduled cooling operation are present, execution proceeds to block 208. At block 208, printing (if any) is stopped. Also at block 208, the controller 108 changes the state or position of the clutch 112 (FIG. 1) from driving the system 114 to driving the pump 104. Execution then proceeds to block 210. At block 210, the controller 108 determines whether the chamber 120 is low on ink 126.

In one embodiment, the controller 108 estimates the amount of ink 126 in the chamber 120 by counting, or estimating, the number of drops of ink ejected by the printhead 140 and the revolutions of the pump 104 in depositing ink into the chamber 120 via the port 176. If the controller 108 determines that the amount of ink 126 in the chamber 120 is equal to or greater than a predetermined amount, execution proceeds to block 214, else execution proceeds to block 212.

Figure 3:
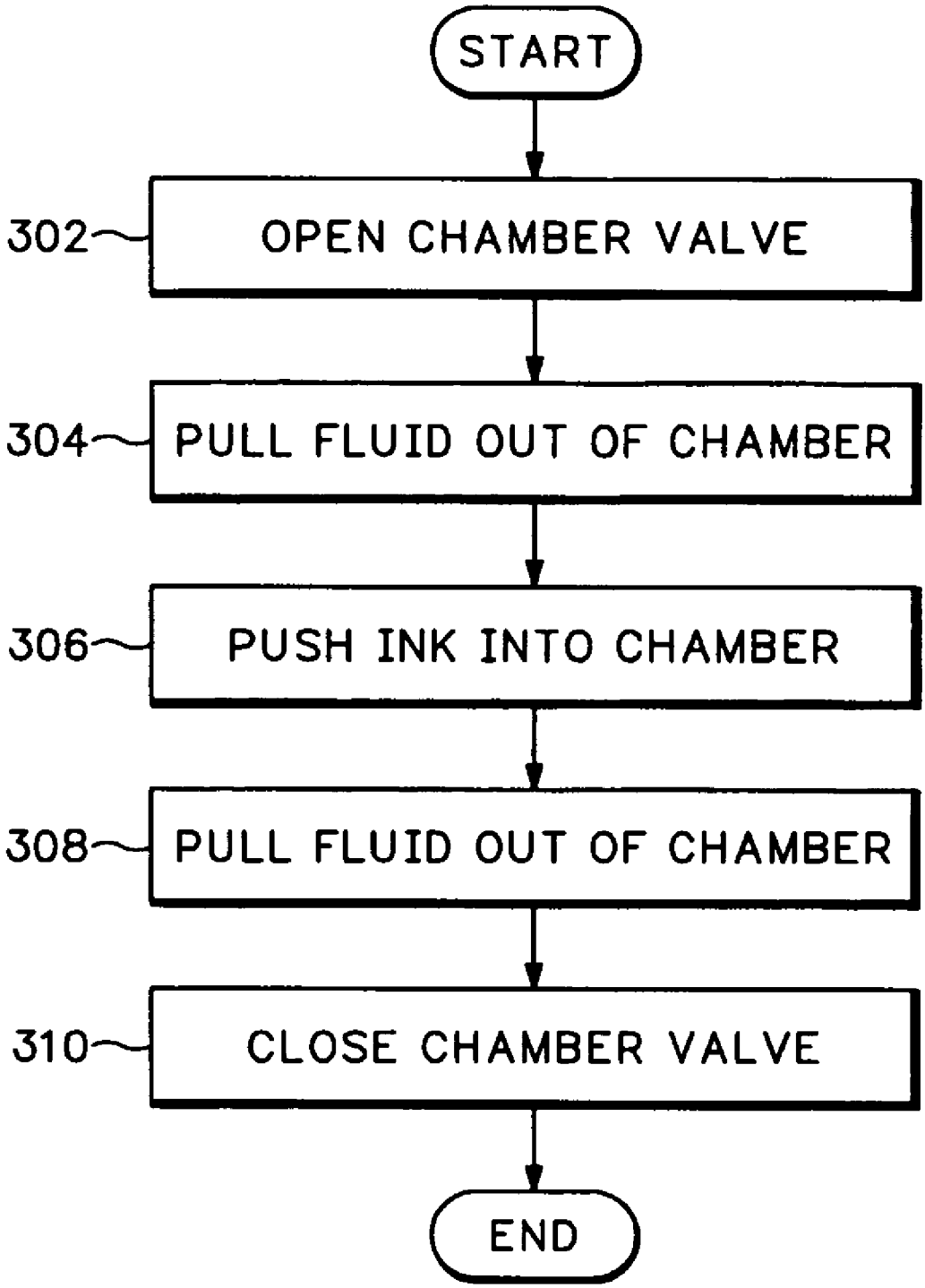
FIG. 3 is a flowchart illustrating an example method of filling a print cartridge in accordance with an example embodiment.

At block 212, the controller 108 initiates and monitors a refill operation for at least partially refilling the chamber 120 with ink from the external ink supply 110. Details of an example embodiment of a refill operation are illustrated in FIG. 3 and are described below with reference to FIG. 3.

At block 214, controller 108 opens the snorkel valve 180 to permit fluid to pass between the snorkel 122 and the port 176. After the controller 108 has opened the snorkel valve 180, execution proceeds to block 216.

At block 216, the controller 108 drives the pump 104 in a reverse, or backward, direction to pull fluid from the snorkel 122, through the snorkel valve 180, through the port 176, and into the conduit 179. In some applications, the pump 104 may pump the fluid from the snorkel 122 to the pump 104 and into the external ink supply 110. The fluid pumped from the snorkel 122 pursuant to block 216 may comprise air, ink, or both. In some instances, the fluid pumped from the snorkel 122 may include foam.

Pulling fluid from the snorkel 122 through the snorkel valve 180, pursuant to block 216 lowers the pressure within the snorkel 122 and thereby tends to pull ink into the snorkel 122 through the channel 154 and the apertures 160, 162. This operation also tends to pull ink 126 within the chamber 120 into the channel 154 through apertures 150, 152. Thus, ink 126 within the chamber 120 circulates through the channel 154 and across the printhead 140 as the pump 104 pulls fluid from the snorkel 122 via the snorkel valve 180. This circulation of the ink 126 across the printhead 140 tends to cool or heat the printhead 140 by permitting heat transfer between the circulating ink and the printhead 140. In circumstances where the circulating ink is warmer than the printhead, the circulating ink heats the printhead. In circumstances where the circulating ink is cooler than the printhead, the circulating ink cools the printhead.

After a significant amount of printing, the temperature of the ink 126 in the chamber 120 is typically significantly lower than the current temperature of the printhead 140. Hence, after a period of printing, the temperature of the ink in the channel 154 is usually higher than the temperature of the ink 126 in the chamber 120. Accordingly, by circulating the ink 126 in the chamber 120 across the printhead 140, the printhead 140 is cooled. Heat at the printhead 140 is transferred to the circulating ink 126 as the ink 126 passes from the chamber 126, through the channel 154, and into the snorkel 122.

At block 218, the controller 108 determines whether the printhead 140 temperature is within a predetermined temperature range. If, according to block 218, the controller 108 determines that the printhead is within the predetermined temperature range, execution proceeds to block 210, else execution returns to block 216.

At block 220, the controller 108 closes the snorkel valve 180. With the snorkel valve 180 closed, thereby preventing fluid from passing between the snorkel 122 and the port 176, execution proceeds to block 222. At block 222, the chamber 120 is filled with ink. Details of an example embodiment of a method for filling the chamber 120 are shown in FIG. 3 and are discussed below with reference to FIG. 3. In one embodiment, the refilling of block 222 is performed pursuant to the method shown in FIG. 3 and described below, without performance of the step 304 (FIG. 3). With the chamber 120 filled pursuant to block 222, execution proceeds to block 224. At block 224, the controller 108 deactivates the heating element 172 if the heating element is in an activated state. Execution then returns to block 201.

FIG. 3 is a flowchart 300 that illustrates an example method for refilling a print cartridge in accordance with an embodiment. At block 302, the controller 108 opens the chamber valve 178 to permit exchange of fluid between the port 176 and the chamber 120. The snorkel valve 180 is maintained closed. Next, pursuant to block 304, the controller 108 signals the pump 104 to pull fluid out of the chamber 120. In one embodiment, the pump 104 pulls fluid out of the chamber 120 until the accumulator bag 166 is at or near its maximum volume. In some embodiments, the controller 108 monitors an approximate volume of ink 126 within the chamber 120 such as by counting the number of drops of ink fired from the printhead 140. As mentioned above, block 304 is optional and, in one embodiment, is not performed as a part of the refill operation of block 222 (FIG. 2).

Then, pursuant to block 306, the controller 108 signals the pump 104 to reverse direction and to pump ink from the external ink supply 110 through the conduit 179 and valve 178 into the chamber 120 until the accumulator bag 166 is substantially at or near maximum volume. At block 308, the controller signals the pump 104 to reverse direction again to pull fluid out of the chamber 308 to develop an adequate backpressure within the chamber 120. Pursuant to block 308, the bubbler 182 may admit ambient air. Finally, at block 310, the controller 108 signals the chamber valve 178 to close.

Figure 4:
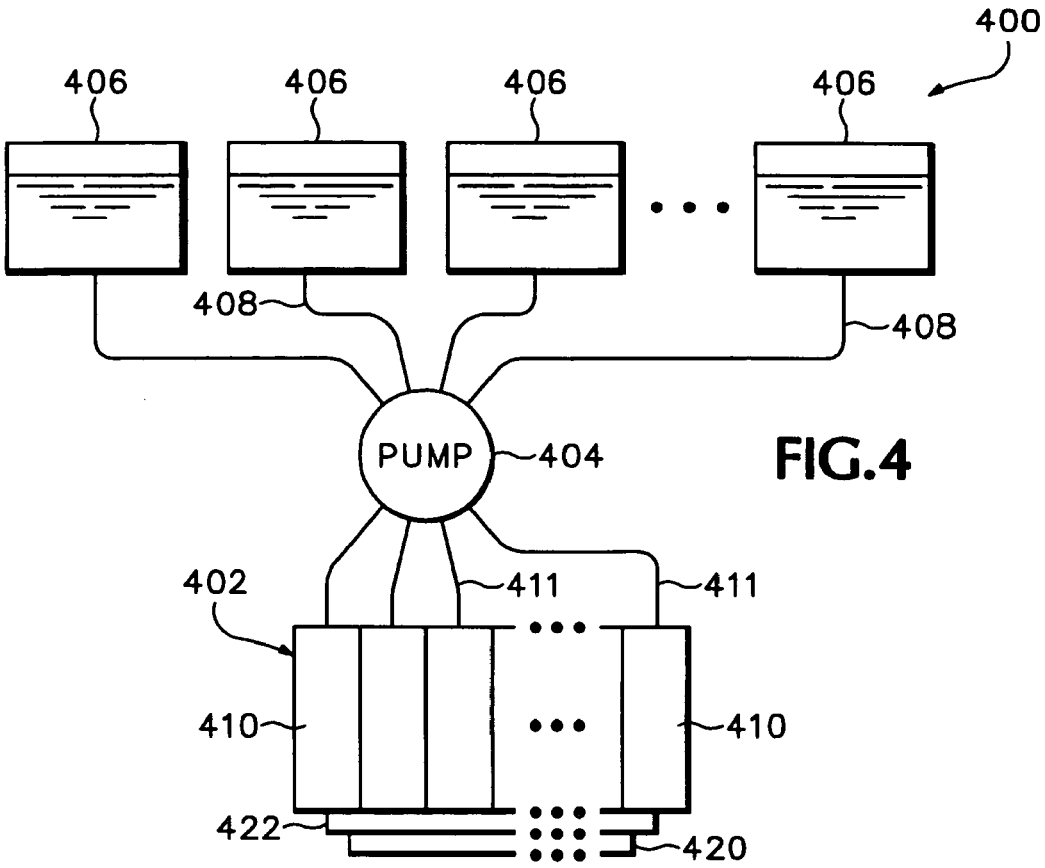
FIG. 4 is a schematic view of an example ink delivery system in accordance with an example embodiment.

FIG. 4 schematically illustrates an example embodiment of an ink delivery system 400 in accordance with an example embodiment. As shown, the ink delivery system 400 generally includes a print cartridge 402, a pump 404, external ink supplies 406, and tubing 408, 411. The tubing 408 permits fluid communication between individual ink supplies 406 and the pump 404. The tubing 411 permits fluid communication between the pump 404 and the individual chambers of the print cartridge 402.

The print cartridge 402, according to this embodiment, has multiple chambers 410 and multiple associated snorkels (not shown), where each snorkel is associated with a chamber. The chambers and snorkels of the print cartridge 402 may be configured and may function identical to the chamber 120 and the snorkel 122 shown in FIG. 1 and described above. Each of the external ink supplies 406 may contain a different color or different type of ink. Hence, in this embodiment each of the chambers of the print cartridge 402 may have a different color or type of ink disposed therein.

The print cartridge 402 is mounted on a carriage (not shown) and traverses print media (not shown) to deposit ink through a printhead 420 onto the print media. The, base 422 in this embodiment is configured as a manifold to permit ink from the several chambers to be delivered to the printhead 420. A venting chamber (not shown) may also be coupled to the ink supplies 406 to permit venting thereof.

Figure 5:
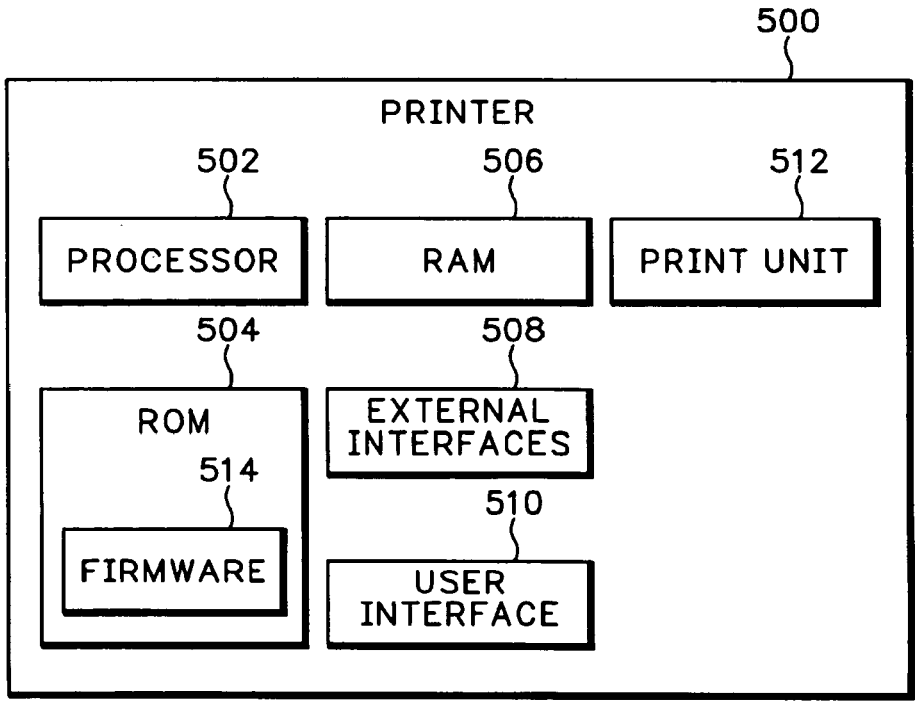
FIG. 5 is a schematic diagram of an example printer in which embodiments may be practiced.

FIG. 5 is a block diagram illustrating pertinent components of a printer 500 and shows an environment in which embodiments of the present invention may be practiced. As shown, the printer 500 includes one or more processors 502, ROM (Read Only Memory) 504, RAM (Random Access Memory) 506, one or more external interfaces 508, user interface 510, and a print unit 512. The ROM 504 includes firmware 514 comprises a computer readable medium including instructions for performing the methods described above. The print unit 512 may include the ink delivery system 400 described above and shown in FIG. 4 and be adapted with suitable media handling, and service station mechanisms.

Figure 6:
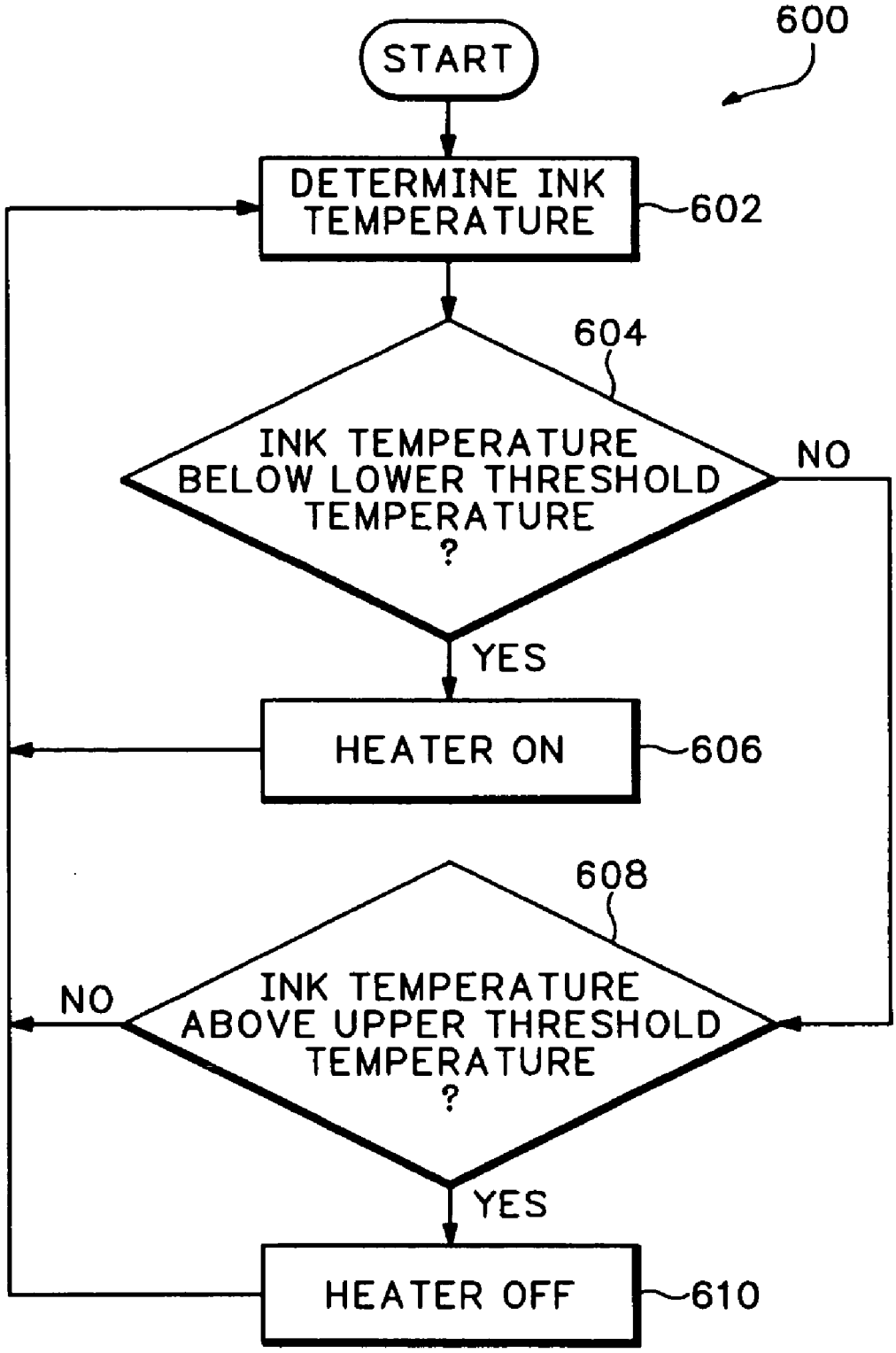
FIG. 6 is a flowchart illustrating a method of controlling ink temperature in a print cartridge in accordance with an example embodiment.

FIG. 6 illustrates a flowchart 600 that shows a method for controlling ink temperature in a print cartridge. The method of FIG. 6 may be useful in maintaining the ink temperature within a predetermined range defined between lower and upper threshold temperatures. For example, the method of FIG. 6 may be employed by the controller 108 of the print cartridge 102 of FIG. 1 to control the temperature of the ink 126 disposed in the chamber 120 using the heating element 172. The flowchart 600 will be described with reference to the print cartridge 102 of FIG. 1, although the method of FIG. 6 may be used with other print cartridges. At block 602, the controller 108 determines the temperature of the ink 126 disposed within the chamber 120. This determination may be made using the temperature sensor 119, which may be disposed within the chamber 120. The temperature sensor 119 may comprise a thermocouple temperature sensor or other suitable temperature sensor.

At block 604 the controller 108 determines whether the measured temperature of the ink 126 is below a lower threshold temperature. The lower threshold temperature defines the lowest temperature of the desired temperature range for the ink 126 in the chamber 120. If the controller 108 determines that the measured temperature of the ink 126 is below the lower threshold temperature then execution proceeds to block 606, else execution proceeds to block 608.

At block 606, the controller 108 activates, or turns on, the heating element 172. If the heating element 172 is already activated, the controller 108 at block 606 maintains the heating element 172 activated. Execution then returns to block 602.

At block 608, the controller 108 determines whether the measured temperature of the ink 126 is above an upper threshold temperature. The upper threshold temperature defines the highest temperature of the desired temperature range for the ink 126 in the chamber 120. If the controller 108 determines that the measured temperature of the ink 126 is above the upper threshold temperature then execution proceeds to block 610, else execution proceeds to block 602.

At block 610, the controller 108 turns off, or deactivates, the heating element 172. If the heating element 172 is already deactivated, the controller 108 at block 610 maintains the heating element 172 deactivated. Execution then returns to block 602.

Accordingly, using the heating element 172 and the method illustrated in FIG. 6, the controller 108 may maintain the temperature of the ink 126 within the chamber 120 within a predetermined temperature range defined by lower and upper threshold temperatures. By maintaining the temperature of the ink 126 image quality problems associated with ink temperature may be reduced or avoided.

While embodiments of the present invention have been particularly shown and described, those skilled in the art will understand that many variations may be made therein without departing from the scope of the invention as defined in the following claims. The foregoing example embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A method comprising:

determining a current temperature of a printhead;

circulating ink across the printhead only if the determined current temperature of the printhead is above a first threshold temperature;

monitoring the current temperature of the printhead;

ceasing the circulating upon detection that the current temperature is below a second threshold temperature.

2. The method of claim 1, further comprising:

determining whether a current temperature of ink disposed in a chamber in fluid communication with the printhead is above a threshold temperature;

heating the ink disposed in the chamber based on the determining whether the current temperature of the ink disposed in the chamber in fluid communication with the printhead is above the threshold temperature.

3. The method of claim 2, further comprising ceasing the heating the ink disposed in the chamber in response to determining that the current temperature of the ink disposed in the chamber is above the threshold temperature.

4. The method of claim 2, wherein the heating is performed by a heating element disposed in the chamber.

* * * * *

UNITED STATES PATENT AND TRADEMARK OFFICE

CERTIFICATE OF CORRECTION

PATENT NO. : 7,300,130 B2
APPLICATION NO. : 11/237307
DATED : November 27, 2007
INVENTOR(S) : Teresa Bellinger et al.

It is certified that error appears in the above-identified patent and that said Letters Patent is hereby corrected as shown below:

On the Title page, in field (56), under "U.S. Patent Documents", in column 1, line 6,
delete "4,929,963 A 5/1990 Balazar" and
insert -- 4,929,983 5/1990 Barton et al. --, therefor.

On the Title page, in field (56), under "U.S. Patent Documents", in column 2, line 4,
delete "5,455,606 A 10/1995 Keeling et al." and
insert -- 5,455,605 10/1995 David, Jr. et al. --, therefor.

On the Title page, in field (56), under "U.S. Patent Documents", in column 2, line 7,
delete "5,886,718 A 3/1999 Johnson et al." and
insert -- 5,886,716 3/1999 Heinzl et al. --, therefor.

Signed and Sealed this

Nineteenth Day of August, 2008

JON W. DUDAS
*Director of the United States Patent and Trademark Office*